United States Patent [19]

Tomoyori et al.

[11] Patent Number: 4,806,972

[45] Date of Patent: Feb. 21, 1989

[54] PRINTER

[75] Inventors: Makoto Tomoyori, Iwate; Sunao Hatanaka, Takizawa, both of Japan

[73] Assignee: Alps Electric Co., Ltd., Japan

[21] Appl. No.: 88,688

[22] Filed: Aug. 24, 1987

[30] Foreign Application Priority Data

Nov. 26, 1986 [JP] Japan ..... 61-279797

[51] Int. Cl.[4] ..... G03G 15/01

[52] U.S. Cl. ..... 355/4; 355/3 BE; 355/3 DD

[58] Field of Search ..... 355/4, 3 DD, 14 D, 14 R, 355/3 BE, 16

[56] References Cited

U.S. PATENT DOCUMENTS

| | | | |
|---|---|---|---|
| 4,569,584 | 2/1986 | St. John et al. | 355/14 R |
| 4,593,991 | 6/1986 | Aoki et al. | 355/14 D |
| 4,699,500 | 10/1987 | Lubberts et al. | 355/4 |
| 4,705,385 | 11/1987 | Palm et al. | 355/4 |
| 4,712,906 | 12/1987 | Bothner et al. | 355/4 X |

*Primary Examiner*—A. C. Prescott

*Attorney, Agent, or Firm*—Guy W. Shoup; Paul J. Winters

[57] ABSTRACT

A printer according to this invention comprises a latent image supporter having an endless belt shape and provided with separate image-forming regions, and a developing unit capable of independently supplying toners of different colors onto latent images formed on the latent image supporter. With the above arrangement, latent images for different colors are formed in the respective image-forming regions of the latent image supporter. Toners of the individual colors are then supplied to the respective latent images, thereby forming toner images of the respective colors. The toner images are transferred onto a sheet to provide an intended color mixing, and are then fixed by a fixing unit. The charges and toners remaining on the surface of the latent image supporter are removed by a static eliminator and a cleaner, respectively, so that the belt becomes ready for the next printing cycle.

2 Claims, 4 Drawing Sheets

PRINTER

BACKGROUND OF THE INVENTION

This invention relates to a printer for printing characters, symbols, figures, and the like onto a sheet of paper, and more particularly, to a compact printer for providing a color printing.

Typical conventional printers of this type are page printers, which are represented by laser printes.

As illustrated in FIG. 7, according to a page printer, sheets 2 of a given size, such as B5 or A4, which are set in a sheet feeding cassette 1, are fed onto a sheet feeding passage 4 one by one by a hopping roller 3. While the sheet 2 is fed along the sheet feeding passage 4, print data such as characters corresponding to a printing pattern is formed on this sheet by an assembly comprising a photosensitive drum 5. More specifically, the photosensitive drum 5 whose axial length is greater than the maximum width of the sheet 2 is rotated in the direction A as indicated by an arrow in FIG. 7 so that the photosensitive drum 5 is uniformly charged by a charging unit 6 arranged over the peripheral surface of the photosensitive drum 5. Then, an electrostatic latent image corresponding to the printing pattern is formed on the surface of the photosensitive drum 5 by an optical writing unit 7, and toners are selectively supplied to the electrostatic latent image on the photosensitive drum 5 using a developing unit 8, thereby forming a toner image on the photosensitive drum 5. When the toner iamge reaches a transferring unit 9 with a rotation of the photosensitive drum 5, it is transferred onto the sheet 2 by the static attraction caused by the transferring unit 9. The sheet 2 is then separated from the photosensitive drum 5 and is conveyed to a fixing unit 10, where the toner image is fixed onto the sheet 2 by heat and/or pressure. Then, the sheet 2 is discharged onto a discharge tray 11. Meanwhile, after passing the transferring unit 9, the photosensitive drum 5 has its remaining charges removed by a static eliminator 12 and then has its remaining toners cleaned off by a cleaner 13.

FIG. 8 illustrates a page printer which provides a color printing on a sheet 2. Reference numerals used in FIG. 7 are also used in FIG. 8 to denote the corresponding elements. In this color page printer, three separate developing units, 8C, 8M and 8Y, are provided above the peripheral surface of the photosensitive drum 5 to respectively supply cyan, magenta and yellow toners. The transferring unit 9 is disposed in a transferring drum 14, which is designed to wind the sheet 2 around its surface for toner-image transfer and then separate the sheet therefrom.

This color page printer performs the color printing in the following manner. First, a latent image for yellow color is formed on the surface of the photosensitive drum 5 by the optical writing unit 7 in accordance with a printing pattern, and yellow toners are transferred onto this latent image by the developing unit 8Y to form a yellow toner image. The yellow toner image on the surface of the photosensitive drum 5 is transferred, by the transferring unit 9, onto the sheet 2, which has been fed from the sheet feeding cassette 1 and is now wound around the transferring drum 14. The sheet 2 with the yellow toner image transferred thereon rotates on the transferring drum 14 as the transferring drum 14 rotates.

Meanwhile, after passing the transferring unit 9, the charges remaining on the surface of the photosensitive drum 5 are removed by the static eliminator 12 and the yellow toners remaining on the photosensitive drum 5 are cleaned off by the cleaner 13. The photosensitive drum 5 then reaches the charging unit 6 which charges the drums surface again so that the photosensitive drum 5 is ready for formation of the next latent image for magenta color. After the latent image for magenta color is formed on the surface of the photosensitive drum 5 by the optical writing unit 7, magenta toners are transferred onto this latent image by the developing unit 8M, thereby forming a magenta toner image on the surface of the photosensitive drum 5. This magenta toner image is then transferred onto the proper location of the sheet 2 wound around the transferring drum 14, by the transferring unit 9.

This series of processes is also carried out for a toner image for cyan color. When these three colors are mixed in the above manner, printing of the desired color is attained. After the cyan toner image is transferred onto the sheet 2, the sheet 2 is separated from the transferring drum 14, supplied to the fixing unit 10, which fixes the resultant color iamge on the sheet, and is then discharged onto the discharging tray 11.

According to this conventional page printer, however, the photosensitive drum 5 is designed to have its axial length greater than the width of the sheet 2. This necessitates that the axial length of each of various units arranged around the photosensitive drum 5, such as the charging unit 6, the optical writing unit 7, developing units 8, 8C, 8M and 8Y, the transferring unit 9, the static eliminator 12, the cleaner 13 and the transferring drum 14, should be nearly equal to the axial length of the photosensitive drum 5. This enlarges the overall size of the page printer and increases the manufacturing cost as a consequence.

The assignee of this application has already proposed a printer to solve the above problem. In this improved printer, the photosensitive drum 5 having a longer axial length than the width of the sheet 2 is replaced with a latent image supporter with an endless belt shape which runs in the width direction of the sheet 2. This design improvement can reduce the size of the overall printer as well as the manufacturing cost and can also provide a high quality printing.

SUMMARY OF THE INVENTION

With the above in mind, it is an object of this invention to provide a printer with the latent supporter of an endless belt shape, which is capable of providing a high quality color printing using a plurality of colors, while maintaining its compactness, light weight and reduced manufacturing cost.

This object is achieved by providing a printer which comprises a latent image supporter with an endless belt shape, and developing means for transferring toners onto a latent image formed on a surface of the latent image supporter so as to form a toner image and is characterized in that the developing means is capable of independently supplying toners of different colors to form toner images of the respective colors, and the latent image supporter is provided with separate image-forming regions in which latent images and toner images for the respective colors are formed.

According to the printer of this invention with the above arrangement, latent images associated with different colors are formed onto the respective image-forming regions, which are provided separately for these colors along the lengthwise direction of the latent image supporter having an endless belt shape, in accordance with a printing pattern. A developing unit transfers toners of the different color onto the associated latent images, thereby forming separate clear toner images. The toner images are conveyed with the latent image supporter in such a manner that the toner image of the first color is transferred onto a sheet when the toner image reaches a position to face the sheet. Thereafter, with the sheet remained at that position, only the latent image supporter is moved such that the toner images of the remaining colors are sequentially transferred onto the sheet. In this manner, different colors are mixed with one another to provide a desired color printing.

Upon completion of transferring the last toner image, the sheet is fed by one line corresponding to the width of the latent image supporter and the printing for the new line is repeated in the same manner as performed for the previous line. By repeating this operation, the printing is executed on the entire sheet.

DETAILED DESCRIPTION OF THE PREFERRED EMBODIMENT

An embodiment of this invention will now be explained with reference to FIGS. 1 through 6.

Figure 1:
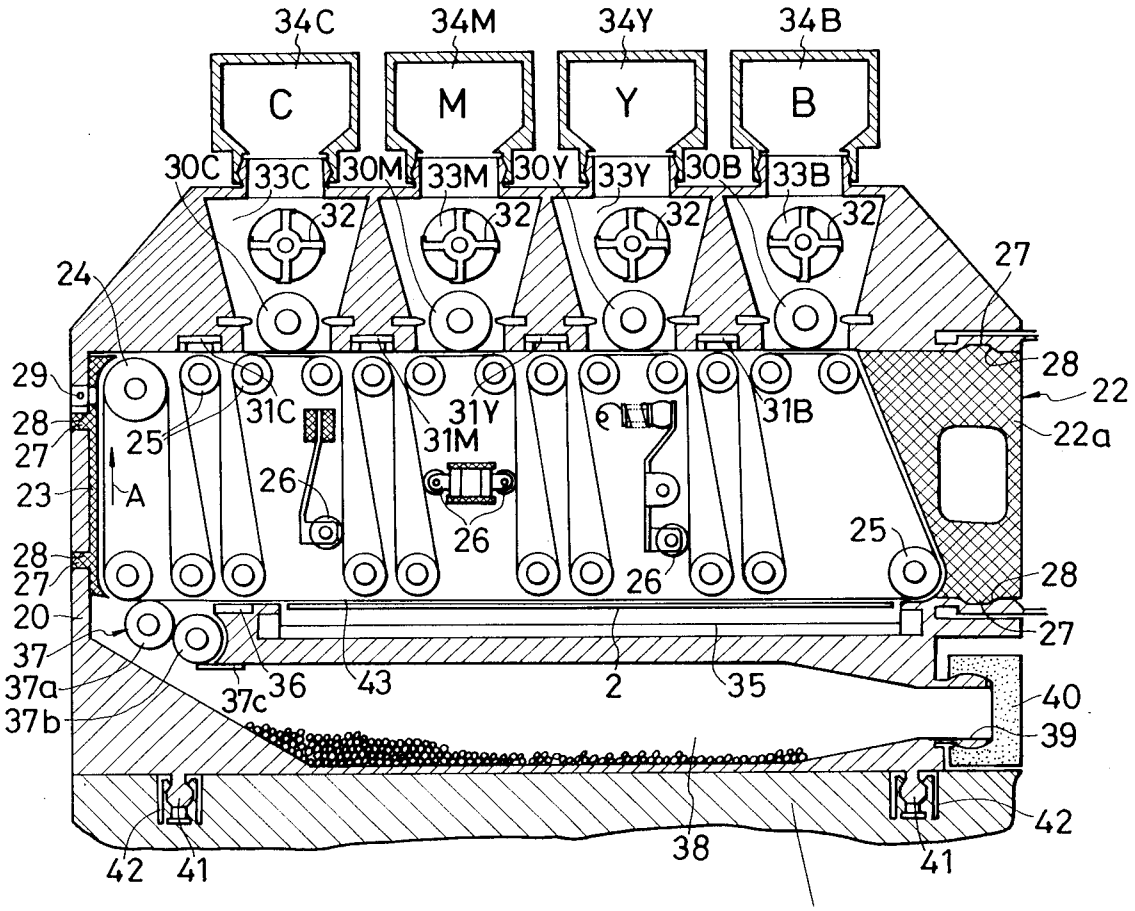
FIG. 1 is a front cross-sectional view of a printer according to an embodiment of this invention.
Figure 2:
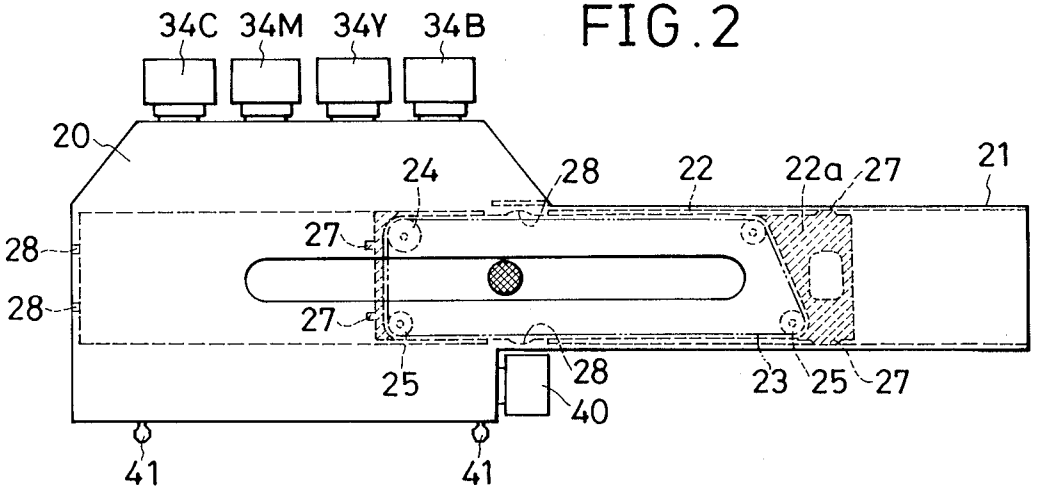
FIG. 2 is a front view illustrating that a latent image supporter unit of the printer of FIG. 1 is inserted into an electrophotographic process unit cartridge using an insert guide.
Figure 3:
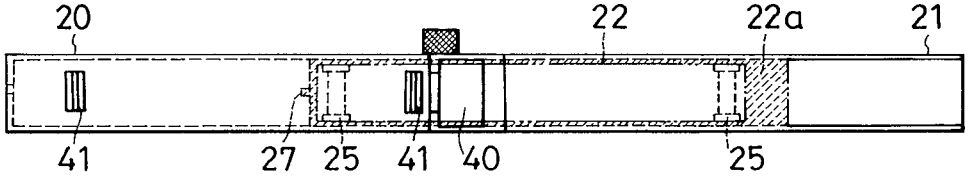
FIG. 3 is a bottom view of FIG. 2.

FIGS. 1 to 3 show an embodiment of this invention.

FIG. 1 is the overall view of this embodiment, which uses an optical writing system.

In the printer according to this embodiment, as shown in FIGS. 1 and 3, a thin electrophotographic process unit cartridge 20, formed of a synthetic resin or the like, accommodates each structural element. As shown in FIGS. 2 and 3, the electrophotographic process unit cartridge 20 is designed such that a rectangular cylinder-shaped insert guide 21 is communicatable with the vertically central portion of the electrophotographic process unit cartridge 20 from the side thereof. A latent image supporter unit 22 is detachably mounted in the accommodation space of the electrophotographic process unit cartridge 20 with the aid of the insert guide 21. An OPC belt 23 of an endless belt shape, which is one type of a latent image supporter, is wound around a drive roller 24 and a plurality of guide rollers 25 within a case **22*a* for the latent image supporter unit 22, and is conveyed along the arrow direction A in the width direction (perpendicular to the sheet conveying direction) by the driving force of the drive roller 24. According to this embodiment, since four color toners, namely, cyan, magenta, yellow and black toners, are used to provide a color printing, the length of the OPC belt 23 is set to be at least four times the width of the sheet 2 and the toner-image forming regions for electrostatic latent images and toner images of different colors are separately provided in the lengthwise direction of the OPC belt 23**.

The tension of the OPC belt 23, when positioned at the proper location, is adjusted by tension rollers 26. The top and bottom surfaces of the case **22*a* are open for the purpose of supplying toners to the OPC belt 23 or transferring toner images onto the sheet 2 from the OPC belt 23. The latent image supporter unit 22 is aligned by engaging a plurality of engagement lugs 27, formed on the case 22*a*, with the associated engagement recesses 28, formed in the electrophotographic process unit cartridge 20. The other structural elements are disposed inside the electrophotographic process unit cartridge 20**. The individual structural elements will be explained as the description of the printing operation is given.

According to this embodiment, toners are supplied to the surface of the OPC belt 23 and toner images are transferred onto the sheet 2. A charging unit 29 is provided outside the drive roller 24 on the left-hand side in FIG. 1 to uniformly charge the surface of the OPC belt 23. Developing units 30C, 30M, 30Y and 30B are disposed above the OPC belt 23 in the downstream of the charging unit 29 in the belt-advancing direction. These developing units independently transfer toners of different colors, namely, cyan C, magenta M, yellow Y and black B, onto the latent images formed on the surface of the OPC belt 23.

Optical writing heads 31C, 31M, 31Y and 31B are disposed in the preceding stages of the associated developing units 30C, 30M, 30Y and 30B in the belt-advancing direction, and have each an LED head provided with a plurality of light emitting sections arranged in the direction perpendicular to the belt-advancing direction. The optical writing heads 31C, 31M, 31Y and 31B form latent images associated with the individual colors, onto the surface of the OPC belt 23. Toner cabins 33C, 33M, 33Y and 33B are located above the respective developing units 30C, 30M, 30Y and 30B. Each of the toner cabins 33C, 33M, 33Y or 33B has a toner stirrer 32 provided at its center portion to stir toners, and also has a top opening in which an associated toner cartridge 34C, 34M, 34Y or 34B is detachably mounted to supply toners of the associated color. According to this embodiment, the sheet 2 can pass through the electrophotographic process unit cartridge 20 in the vertical direction of the sheet in FIG. 1, below the bottom opening of the case **22*a*. When a toner image of each color formed on the surface of the OPC belt 23 reaches above the sheet 2, the toner image is transferred onto the sheet 2 by. To provide such image transfer, a transferring unit 35 is provided below the sheet 2, extending over the entire width of the sheet 2. A static eliminator 36, such as EL, is disposed downstream of the transferring unit 35 in the belt-advancing direction in order to remove charges remaining on the OPC belt 23**.

Downstream of the static eliminator 36 lies a cleaner 37 which removes toners remaining on the surface of the OPC belt 23. The cleaner 37 comprises a sponge roll **37*a* for removing the remaining toners from the OPC belt 23, a magnetic roll 37*b* for removing the toners from the sponge roll 37*a*, and a blade 37*c* for cleaning the toners off the magnetic roll 37*b* into a toner discharging section 38. The cleaned-off toners are collected from the toner discharging section 38 through a discharging exit 39, which is usually covered bya cap 40. The electrophotographic process unit cartridge 20 has male coupling members 41 formed on its bottom surface at the right and left ends. The male coupling members 41 are designed to mate with female coupling members 42 that are formed in the upper portion of the printer assembly, so that the electrophotographic process unit cartridge 20** can be detachably mounted to the printer assembly.

The following explains the operation of the printer according to this embodiment.

The printer according to this embodiment prints print data for one line corresponding to the width of the OPC belt 23, onto the sheet 2, and then feeds the sheet 2 by one line for printing the next line.

First, the drive roller 24 rotates in response to a print start instruction, thus rotating the OPC belt 23 in the direction A in FIG. 1. The surface of the OPC belt 23 is charged with the charging unit 29. As the OPC belt 23 advances, the individual optical writing heads 31C, 31M, 31Y and 31B form latent images in the respective image-forming regions on the surface of the belt 23, and the individual developing units 30C, 30M, 30Y and 30B form toner images in the same regions.

This process will be explained in detail with regard to cyan C. While the image-forming region for cyan on the OPC belt 23 is passing under the optical writing head 31C, a latent image for cyan is formed in this region by the head 31C in accordance with a printing pattern. The formation of the cyan latent image is continuously performed in the units of lines of the OPC belt 23. Then, the cyan developing unit 30C supplies cyan toners onto the formed cyan latent image to form a cyan toner image on the surface of the OPC belt 23. The same process for forming the cyan latent and toner images is executed for the other colors, using the optical writing heads 31M, 31Y and 31B and the developing units 30M, 30Y and 30B, respectively.

When the toner images for the respective colors formed on the surface of the OPC belt 23 further advance and the leading edge of the first line of the cyan toner image reaches a line transfer position 43 of the transferring section, the OPC belt stops. The cyan toner image is electrostatically transferred onto the sheet 2 by the transferring unit 35. Thereafter, with the sheet 2 remaining there, the OPC belt 23 alone is conveyed to execute the same printing operation for the remaining colors. When the leading edge of the magenta toner iamge immediately following the cyan toner image reaches the line transfer position 43, the OPC belt 23 stops and the magenta toner image is transferred on the sheet 2 by the transferring unit 35. Then, with the sheet 2 remaining unmoved, only the OPC belt 23 is further conveyed to be ready for the same printing operation for the subsequent yellow toner image. When transferring of the black toner image (last toner image) is completed in the above manner, the individual colors (four colors in this embodiment) are properly mixed to provide the intended color printing. While the OPC belt 23 is conveyed from the line transfer position 43, the charges remaining on the surface of the OPC belt 23 are removed by the static eliminator 36 and the remaining toners are then removed by the cleaner 37.

Upon completion of transferring the least, black toner image, the sheet 2 is fed by one line corresponding to the width of the OPC belt 23 to be ready for the printing operation for the next line. The above-described series of printing processes is repeated until the color printing is executed over the entire sheet 2. As the sheet 2 is fed by one line, that portion of the OPC belt 23 which has undergone the toner image transfer operation is subjected to removal of the remaining charges while passing under the static eliminator 33 and to removal of the remaining toners while passing under the cleaner 37. Then, the OPC belt 23 again becomes ready for the next printing cycle.

The toner images transferred onto the sheet 2 are fixed while passing the fixing unit (not shown) as the sheet advances.

According to this embodiment, since toners of plural colors are transferred onto the image-forming regions exclusively provided on the surface of the OPC belt 23 for the respective colors, toner images of the individual colors can be formed on the OPC belt 23 with a high reproducibility. This significantly improves the resolution of the printed product.

In addition, since the latent image supporter unit 22 is designed to be detachably mounted inside the electrophotographic process unit cartridge 20, the latent image supporter unit 22 can be easily removed therefrom to check the abnormally of the OPC belt 23 or clean it.

Figure 4:
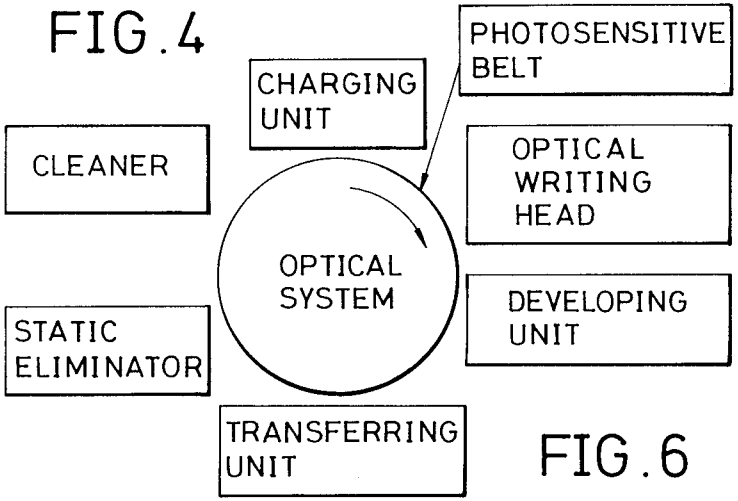

As mentioned earlier, this embodiment uses an optical wiring system, which is illustrated in a block diagram in FIG. 4.

Figure 5:
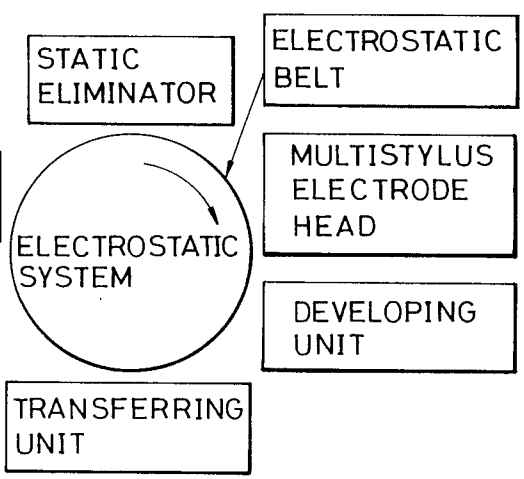
FIGS. 4 to 6 are schematic block diagrams showing embodiments of this invention.
Figure 6:
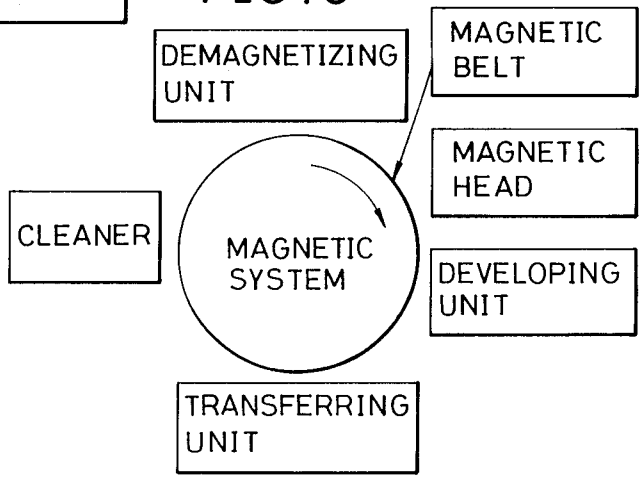
Figure 7:
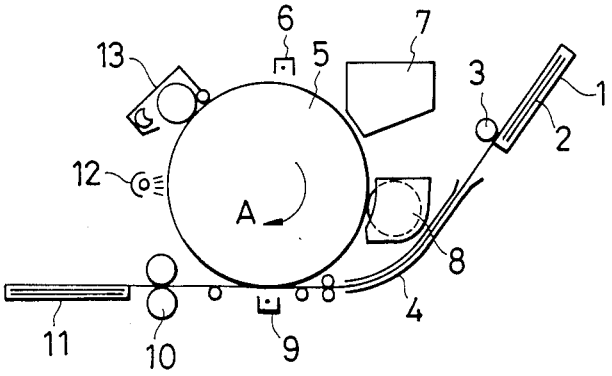
FIG. 7 PRIOR ART
FIGS. 7 and 8 are vertical cross-sectional views schematically showing conventional page printers.
Figure 8:
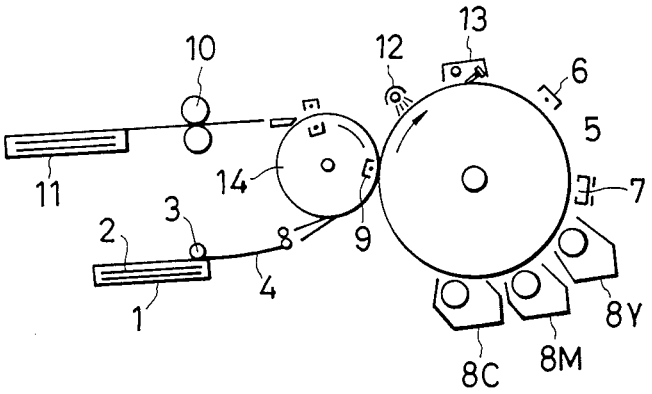
FIG. 8 PRIOR ART

Alternatively, this invention can use the electrostatic system shown in FIG. 5 as well as the magnetic system shown in FIG. 6.

In the electrostatic system of FIG. 5, an endless electrostatic belt is used as a latent image supporter, latent images are electrostatically formed on the surface of this belt using a multistylus electrode head, the latent images are transformed into toner images by a plurality of developing units, and the toner images are transferred on a sheet by a transferring unit. Thereafter, toners remaining on that portion of the electrostatic belt which has undergone the image transfer are removed by a cleaner, and this belt is then de-electrified by a static eliminator to have zero potential to be ready for the next printing cycle.

In the magnetic system of FIG. 6, and endless magnetic belt is used as a latent image supporter, latent images are magnetically formed by a magnetic head, the latent images are transformed into toner images by a plurality of developing units, and the toner images are then transferred onto a sheet by a transferring unit. Toners remaining on that portion of the magnetic belt which has undergone the image transfer operation are removed by a cleaner, and the magnetic belt is then demagnetized by a demagnetizing unit to be ready for the next printing cycle.

With the above-explained arrangement, the printer of this invention, which is provided with a latent image supporter of an endless belt shape, can provide a high quality color printing using a plurality of colors, while maintaining its compactness, light weight and reduced manufacturing cost.

According to the aforementioned embodiment using the optical writing system, the optical writing heads 31C, 31M, 31Y and 31B are provided for the respective colors. However, latent images for different colors may be formed by a single optical writing head.

This invention is not in any way limited by the description of each embodiment; it may be modified in various manners without departing from the scope of this invention.

What is claimed is:

1. A printer comprising:

a latent image supporter of an endless belt shape which travels at a right angle to a direction toward which a recording medium is fed, and a developing unit for applying a toner onto a latent image formed on said latent image supporter to form a visible image, said visible image being intermittently transferred onto said recording medium;

wherein said developing unit is capable of independently supplying toners of different colors, and said latent image supporter is independently provided with image-forming regions in which latent images and toner images for the respective colors are formed.

2. The printer according to claim 1, wherein said developing means comprises a plurality of developing units provided along an advancing direction of said latent image supporter.

* * * * *
* * * * *